US010454149B2

(12) United States Patent
Nummerdor, Jr. et al.

(10) Patent No.: US 10,454,149 B2
(45) Date of Patent: Oct. 22, 2019

(54) TUNING AND MEASUREMENT FIXTURES FOR CERAMIC FILTERS

(71) Applicant: LGS INNOVATIONS LLC, Herndon, VA (US)

(72) Inventors: Jeffrey Jan Nummerdor, Jr., Rio Rancho, NM (US); Alan Scott Brannon, Denver, CO (US); Rebecca Joyce Amparan, Longmont, CO (US); Scott W. Burgess, Albuquerque, NM (US)

(73) Assignee: LDS Innovations LLC, Herndon, VA (US)

( * ) Notice: Subject to any disclaimer, the term of this patent is extended or adjusted under 35 U.S.C. 154(b) by 50 days.

(21) Appl. No.: 15/720,266

(22) Filed: Sep. 29, 2017

(65) Prior Publication Data

US 2018/0131064 A1 May 10, 2018

Related U.S. Application Data

(60) Provisional application No. 62/418,965, filed on Nov. 8, 2016.

(51) Int. Cl.
*H01P 1/205* (2006.01)
*H01P 1/207* (2006.01)

(52) U.S. Cl.
CPC ..... *H01P 1/2056* (2013.01); *H01P 1/205* (2013.01); *H01P 1/207* (2013.01)

(58) Field of Classification Search
CPC ..... H01P 1/2056; H01P 1/205; H01P 1/202; H01P 1/207
USPC ..... 333/207, 206, 202
See application file for complete search history.

(56) References Cited

U.S. PATENT DOCUMENTS

| | | | | |
|---|---|---|---|---|
| 4,535,307 | A * | 8/1985 | Tsukii | G01R 1/24 324/601 |
| 4,837,534 | A | 6/1989 | Van Horn | |
| 5,666,093 | A | 9/1997 | D'Ostilio | |
| 5,684,439 | A | 11/1997 | Vangala | |
| 6,118,356 | A | 9/2000 | Loi et al. | |
| 6,472,885 | B1 * | 10/2002 | Green | G01N 22/00 324/638 |
| 7,619,496 | B2 | 11/2009 | Rogozine | |

FOREIGN PATENT DOCUMENTS

EP 0 508 733 A2 10/1992

* cited by examiner

*Primary Examiner* — Stephen E. Jones
(74) *Attorney, Agent, or Firm* — Baker & Hostetler LLP

(57) ABSTRACT

The application at least describes a tuning and measurement fixture. The fixture comprises a bottom plate including side surfaces, a top surface and a bottom surface. The bottom plate includes a window extending between the top and bottom surfaces. The window can expose a through-hole of a filter positioned in the fixture. In addition, the top surface of the filter includes a signal connection and a ground connection configured to communicate with the filter. The bottom surface of the filter includes an RF port configured to transmit electrical characteristics of the filter. A top plate of the filter includes a top and a bottom surface. The top plate is separated from the bottom plate by a predetermined height. The top plate includes a window extending between the top and bottom surfaces. The window exposes the through-hole of the filter held in the fixture. The application also describes a method of tuning and measuring a filter in a fixture.

20 Claims, 8 Drawing Sheets

TUNING AND MEASUREMENT FIXTURES FOR CERAMIC FILTERS

CROSS-REFERENCE TO RELATED APPLICATIONS

This application claims the benefit of priority of United States Provisional Application No. 62/418,965 filed Nov. 8, 2016, and entitled "Tuning and Measurement Fixtures for Ceramic Filters," the contents of which is incorporated by reference in its entirety herein.

FIELD

This application is generally related to fixtures for ceramic filters for purposes of tuning and measurement.

BACKGROUND

Generally, transmitters and receivers in radio equipment utilize the same antenna. Accordingly, the transmission network controls both the transmission signal and the receiving signal. By so doing, the signal from the antenna is directed to the receiver without any substantial interference from the transmitter, and the signal from the transmitter is transmitted to the antenna without interference from the receiver.

Ceramic filters are typically employed in radio equipment to reduce substantial interference. In particular, duplex ceramic filters including two individual band-pass filters are employed. One filter connects the receiving branch and has a center frequency and bandwidth corresponding to the receiving band. The other filter connects the transmission branch and has a center frequency and bandwidth corresponding to the transmission band.

One technique for tuning ceramic filters is to remove a conductive plating or ceramic dielectric material at the location of its top, patterned surface. This technique allows capacitive coupling between resonators. Alternatively, tuning may be accomplished by removing conductive material at the opposite, short-circuit surface of the filter.

During operation, a ground plane is required underneath the top, patterned surface is and attached to the side walls of the filter. Measurement of the ceramic filter can be accomplished with a mechanical fixture that connects the I/O ports on the ceramic filter to RF ports attached to measurement equipment. However, the ground plane blocks access to the top pattern during measurement. This prevents simultaneous measurement and probing of the coupling locations between individual resonators in the filter.

SUMMARY

The foregoing needs are met, to a great extent, by the invention, with an apparatus and method for simultaneous or quick-succession measurement and tuning of ceramic filters requiring a ground plane.

One aspect of the application describes a tuning and measurement fixture. The fixture comprises a bottom plate including side surfaces, a top surface and a bottom surface. The bottom plate includes a window extending between the top and bottom surfaces. The window can expose a through-hole of a filter positioned in the fixture. In addition, the top surface of the filter includes a signal connection and a ground connection configured to communicate with the filter. The bottom surface of the filter includes an RF port configured to transmit electrical characteristics of the filter.

A top plate of the filter includes a top and a bottom surface. The top plate is separated from the bottom plate by a predetermined height. The top plate includes a window extending between the top and bottom surfaces. The window exposes the through-hole of the filter held in the fixture.

Another aspect of the application describes a method of tuning and measuring a filter in a fixture. The fixture includes a bottom plate including a top surface and a bottom surface. The bottom plate includes a window extending between the top and bottom surfaces. The top surface includes a signal connection and a ground connection for communicating with the filter. The bottom surface includes an RF port for transmitting characteristics of the filter. The top plate includes a top and bottom surface, the top plate is separated from the bottom plate by a predetermined height. The top plate includes a window extending between the top and bottom surfaces. The method includes a step of positioning the filter between the bottom and top plates such that a through-hole of the filter is accessible through the window in the top plate. The method also includes a step of tuning the filter via the window in the top plate. The method further includes a step of measuring electrical characteristics of the filter via the RF port on the bottom plate.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

BRIEF DESCRIPTION OF THE DRAWINGS

In order to facilitate a fuller understanding of the invention, reference is now made to the accompanying drawings, in which like elements are referenced with like numerals. These drawings should not be construed as limiting the invention and intended only to be illustrative.

DETAILED DESCRIPTION

Figure 1A:
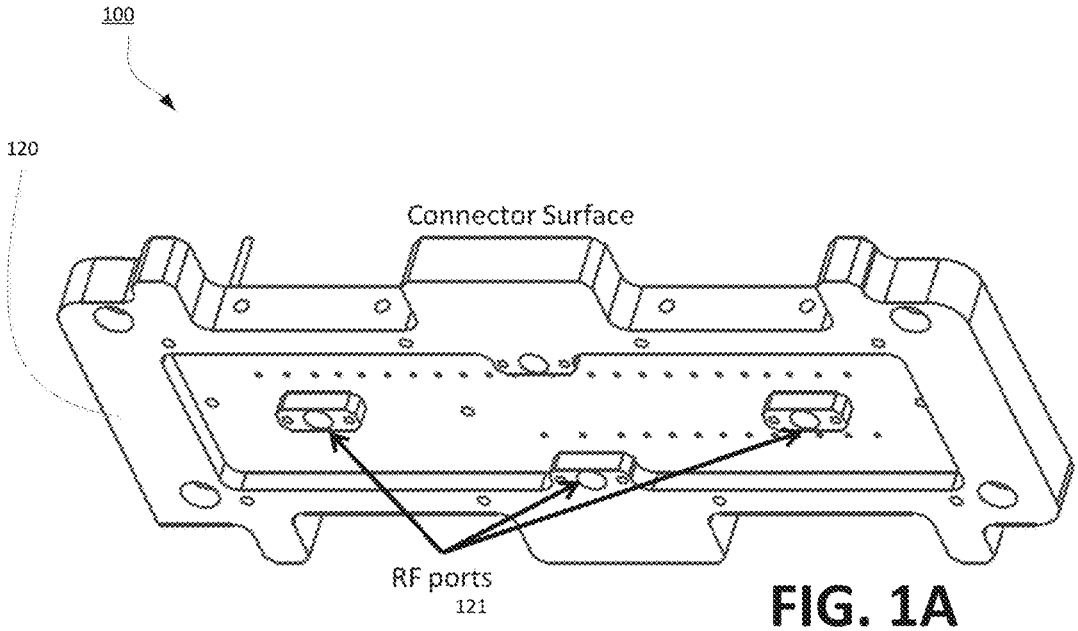
FIGS. 1A and 1B illustrate top and bottom surfaces, respectively, of a bottom plate, of the fixture according to an aspect of the application.

In this respect, before explaining at least one embodiment of the invention in detail, it is to be understood that the invention is not limited in its application to the details of construction and to the arrangements of the components set forth in the following description or illustrated in the drawings. The invention is capable of embodiments or embodiments in addition to those described and of being practiced and carried out in various ways. Also, it is to be understood that the phraseology and terminology employed herein, as well as the abstract, are for the purpose of description and should not be regarded as limiting.

Reference in this application to "one embodiment," "an embodiment," "one or more embodiments," or the like means that a particular feature, structure, or characteristic described in connection with the embodiment is included in at least one embodiment of the disclosure. The appearances of, for example, the phrases "an embodiment" in various places in the specification are not necessarily all referring to the same embodiment, nor are separate or alternative embodiments mutually exclusive of other embodiments. Moreover, various features are described which may be exhibited by some embodiments and not by the other. Similarly, various requirements are described which may be requirements for some embodiments but not by other embodiments.

It has been determined by the inventors and described herein that the inventive fixture provides fast access for automated tuning and highly repeatable and accurate measurement of RF ceramic filters. The fixture helps reduce the cost of the final product in view of enabling automated tuning methods and enhanced performance through fixture to system repeatability. Further, the filter positioned in the tuning and measurement fixture exhibits characteristics similar to a filter mounted on a printed circuit board (PCB) inside a RF system reducing shifts in frequency creating more repeatable results.

Figure 1B:
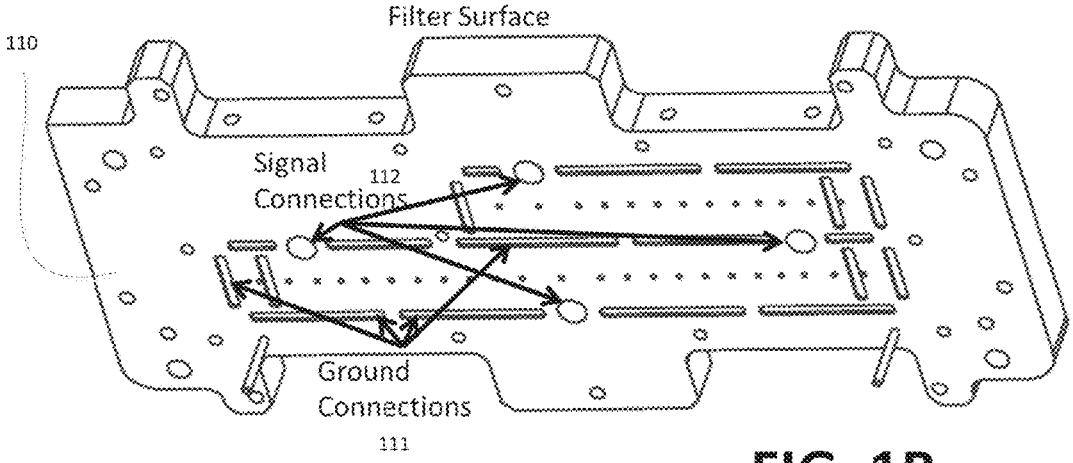

According to a first aspect of the application, a bottom plate 100 of a fixture is exemplary illustrated in FIGS. 1A and 1B. The bottom plate includes a top surface 110 and a bottom surface 120. The top surface 110 is also referred to as the filter surface and is operably in communication with a filter to be tuned and measured within the fixture. The top surface includes a signal connection 112 and a ground connection 111. In an embodiment, there are plural signal connections arranged on the top surface. In another embodiment, there are plural ground connections arranged on the top surface.

The bottom surface 120 is also referred to as the connector surface. The bottom surface includes an RF port 121 that communicates electrical characteristics with electrical equipment. The electrical equipment will be discussed in more detail below.

Figure 2:
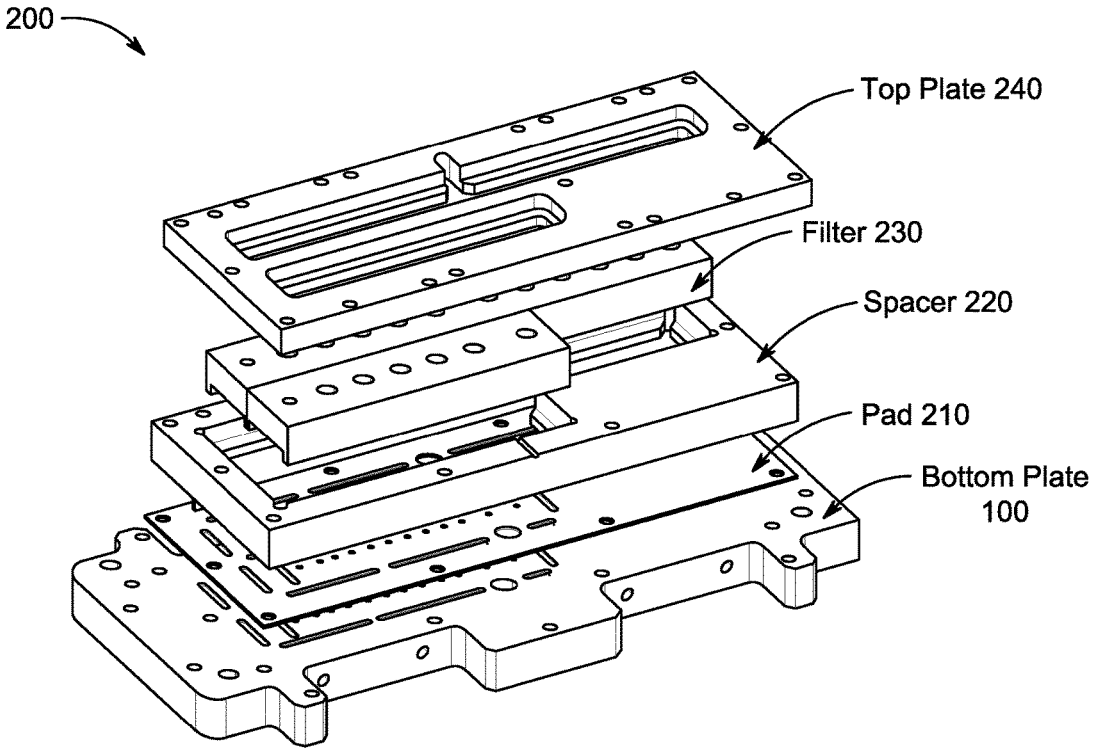
FIG. 2 illustrates a tuning and measurement fixture including a filter therein according to an aspect of the application.

According to an embodiment as exemplary shown in FIG. 2, the fixture 200 includes a pad 210, spacer 220 and top plate 240. A filter 230 is positioned in the fixture. The top plate 240 includes a top and bottom surface. The top plate is separate from the bottom plate by a predetermined height at least equal to the thickness of the filter 230. In one embodiment, the top plate may include one or more windows. The number of windows is dependent upon the number of filters, preferably ceramic filters, placed within the fixture 200. One of the windows extends between the top and bottom surfaces of the top plate.

The filter 230 is positioned above the bottom plate 100. In an embodiment, the filter rests upon a pad 210. The pad includes a pattern that is consistent with a pattern on the top surface of the bottom plate. By so doing, the padding can be exchanged after multiple uses to avoid replacing the bottom plate 100. The filter has a rectangular block shape with one or more through-holes formed therein. The through-holes extend between upper and lower surfaces of the filter 230. The through-holes of the filter are positioned in the fixture 200 such that they are accessible through the window of the top plate.

For the outer metal portion of the fixture/cassette, brass is a preferred material. In one embodiment, a filter is mounted to a pad/PCB such as a Rodgers 4350 PCB board. However, it is envisaged that any PCB can be used that would work well with a filter mounted to an actual radio.

The fixture 200 also includes a spacer 220. The spacer is formed around the filter and rests on top of the bottom plate 100. The spacer 220 provides separation between the top and bottom plates.

Figure 3:
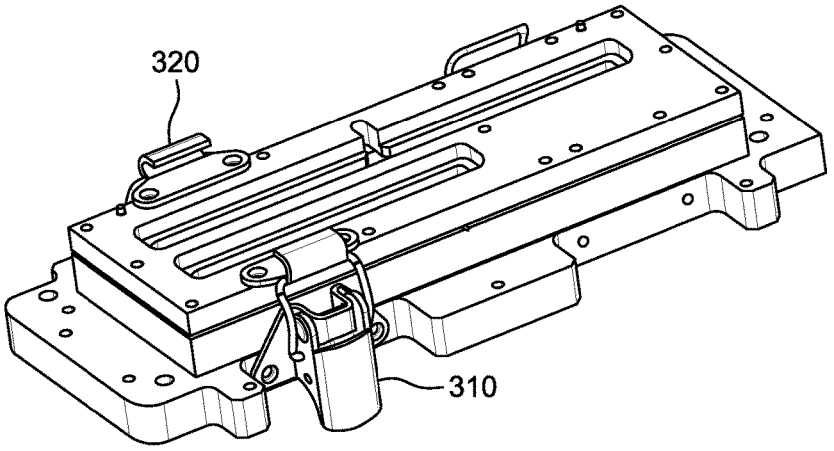
FIG. 3 illustrates a tuning and measurement fixture including a fastening mechanism according to an aspect of the application.

In another embodiment, the fixture 200 includes a fastening mechanism including a clasp 310 and a hook 320 as exemplary shown in FIG. 3. The hook may be affixed to the top plate either on a top surface and/or a side surface thereof. The clasp may be affixed to the bottom plate either on the bottom and/or side surface thereof.

Figure 4A:
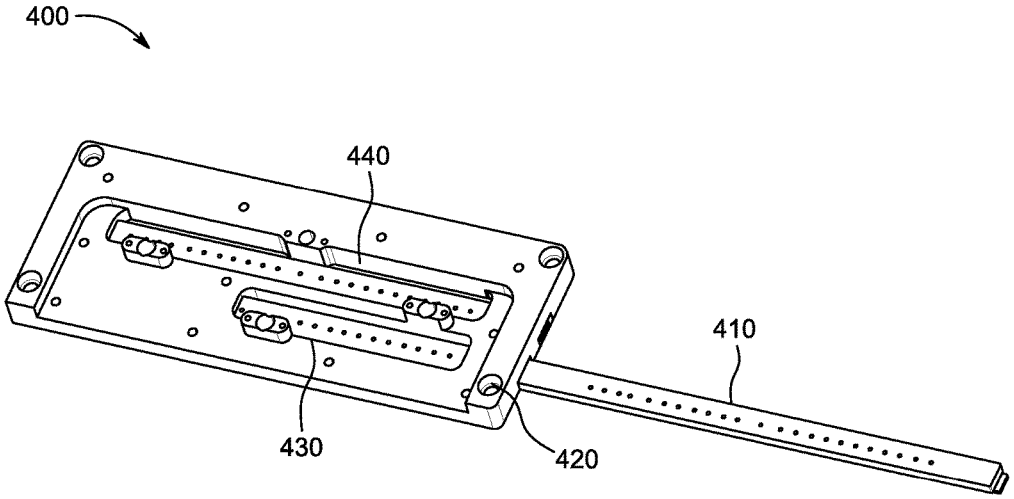
FIGS. 4A and 4B illustrate a lower, connector surface with a slide bar therein according to an aspect of the application.
Figure 4B:
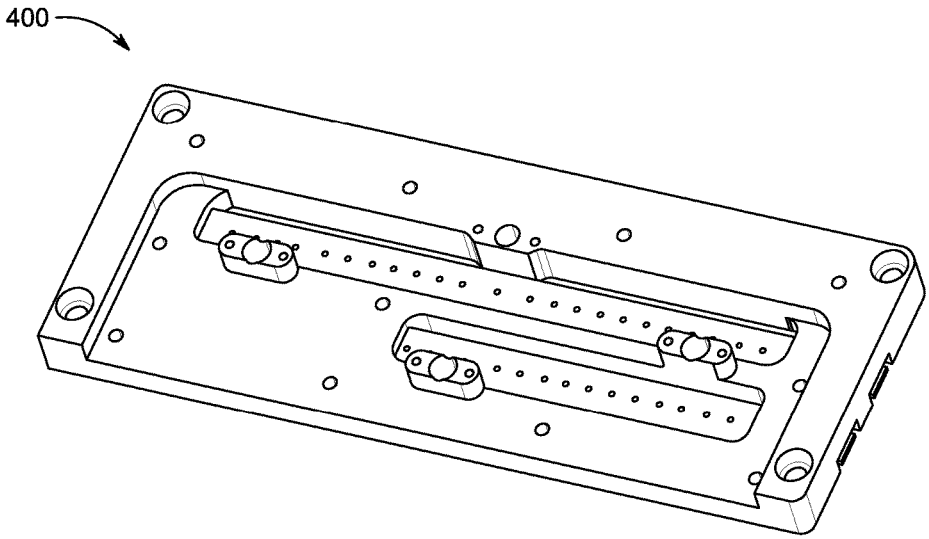

According to another aspect as exemplarily shown in FIGS. 4A and 4B, the bottom plate 400 may include a recessed channel 420 formed there through. In one embodiment, the recessed channel may be positioned between the top and bottom surfaces of the bottom plate 400. The recessed channel may extend a predetermined distance between two side surfaces of the bottom plate. In an exemplary embodiment, the recess channel may extend from one side surface to the other side surface.

A t-bar or slider 410 may removably be positioned in the recess channel 420. FIG. 4A depicts the slider 410 in a state where it is partially located in the recessed channel 420. Meanwhile, FIG. 4B depicts the slider 410 entirely located in the recessed channel 420. The slider 410 may include plural through-holes therein. The through-holes may line up with the through-holes formed in the filter as described above in more detail. According to this embodiment, the bottom plate may include plural recessed channels and plural sliders 410 configured to be removably located therein. The slider may be connected to an electrical stepper motor in order to displace its position in and out of the recessed channel. In so doing, the filter can be tuned by removing silver around the resonator pads or by removing ground around the edge of the filter thereby adjusting the capacitive charge of the filter.

In another embodiment, the bottom plate may be configured to include one or more windows 430, 440. The windows are arranged such that a portion of the ground connection 410 is exposed as shown in FIGS. 4A and 4B.

Figure 5A:
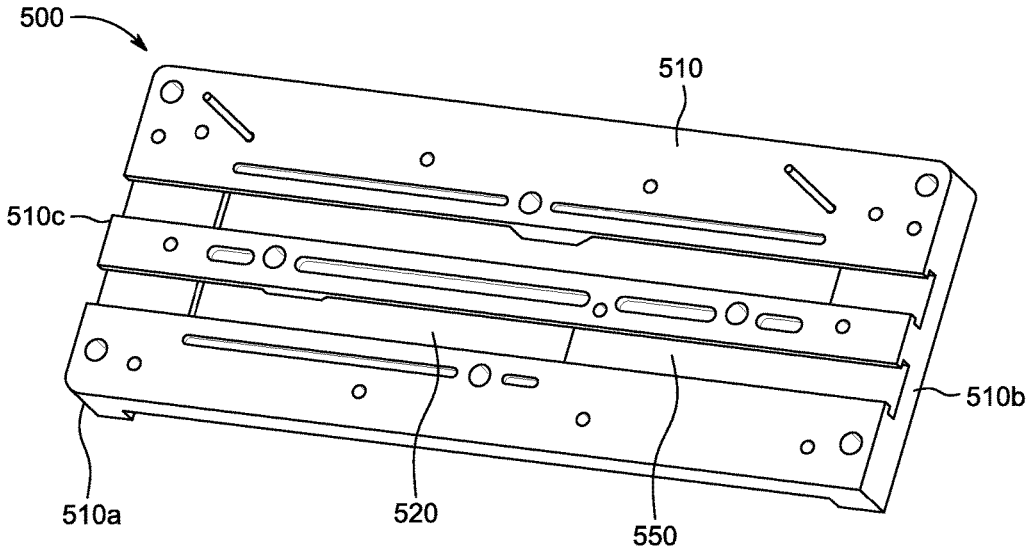
FIGS. 5A-D illustrate a method of turning a filter in a fixture according to an aspect of the application.

Another aspect of this application is directed to a method for making a fixture that holds a filter for tuning and measurement techniques. These steps are exemplarily shown in FIGS. 5A-5D. A bottom plate 510 of the fixture assembly 500 is shown in FIG. 5A. In particular, a top surface 510 of the bottom plate is depicted in FIG. 5A. The top plate surface 510 includes one or more windows 520 and recessed tracks 530 that coincide on at least a portion of the top plate 510. The windows 520 have a width, positioned between two side surfaces of the bottom plate, and is less than a width of the recessed track 530.

In one embodiment, the recessed track 530 extends from one side surface 510*a* to another side surface 510*b*. The recessed track 530 extends a predetermined length from the top surface 510 toward a core of the bottom plate. In an embodiment, the plural, recessed tracks may be arranged such that they are spaced apart by a portion 510*c* of the top surface 510.

Figure 5B:
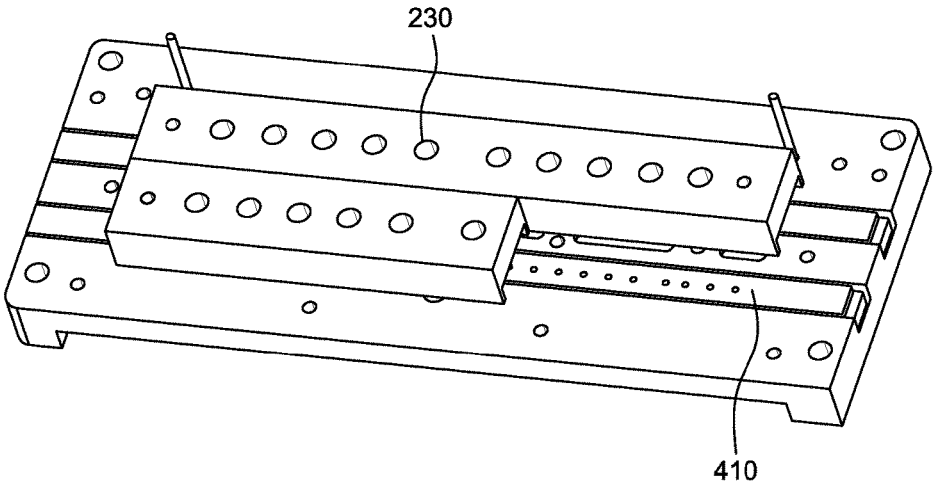

As shown in FIG. 5B, the ground connection may be positioned within the recessed tracks 530. One or more ceramic filter including through-holes may be positioned above the top surface 510 of the bottom plate 500 and the ground connection. The filter may directly be positioned in the center of the top surface 510. The filter is directly be positioned over a portion of the ground connection and has a PCB located between the top surface 510 and a bottom surface of the ceramic filter.

Figure 5C:
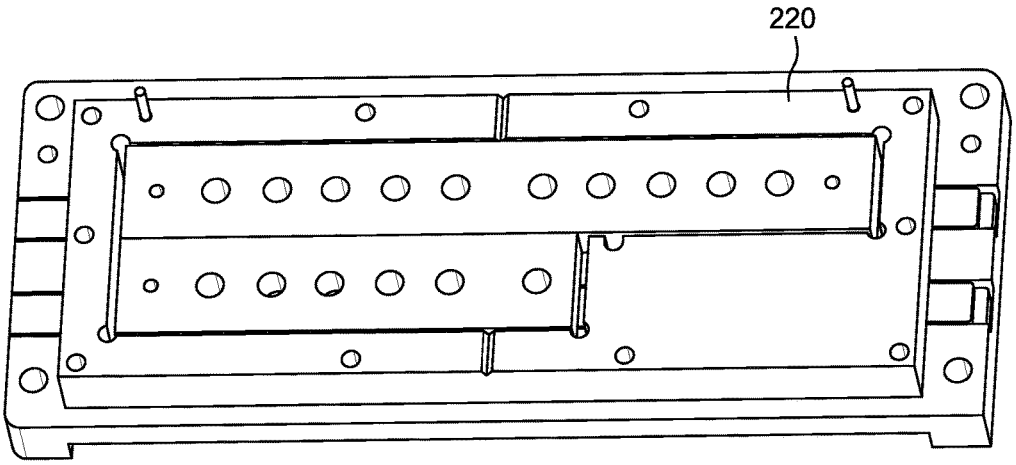

According to FIG. 5C, a spacer is positioned above the top surface 510 and the slider is located in the recessed track 530. The spacer may encompass a perimeter of the filter positioned above the top surface 510. A height of the spacer is at least equal to the height of the filter. By so doing, unnecessary forces are prevented from being exerted on the ceramic filter.

Figure 5D:
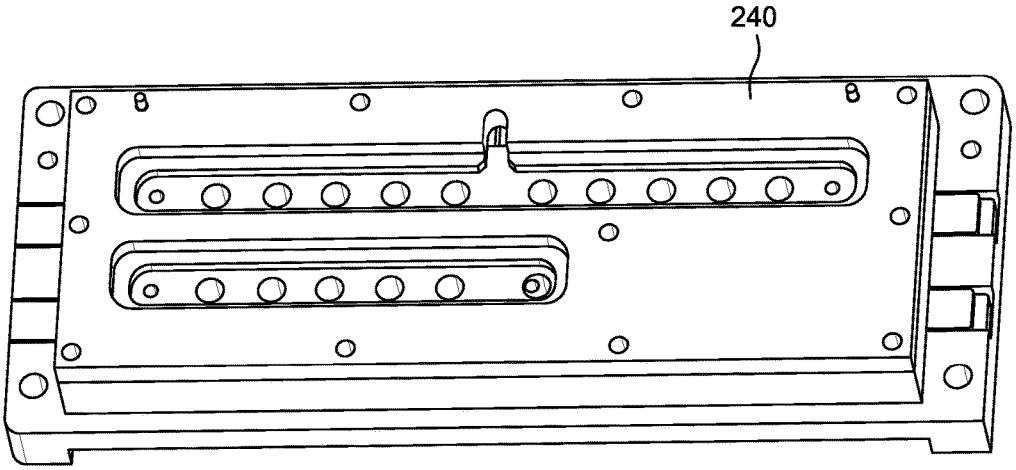

In FIG. 5D, a top plate is formed above the filter and the spacer. In an embodiment, the dimensions of the top plate are generally consistent with the dimensions of the spacer.

Figure 6:
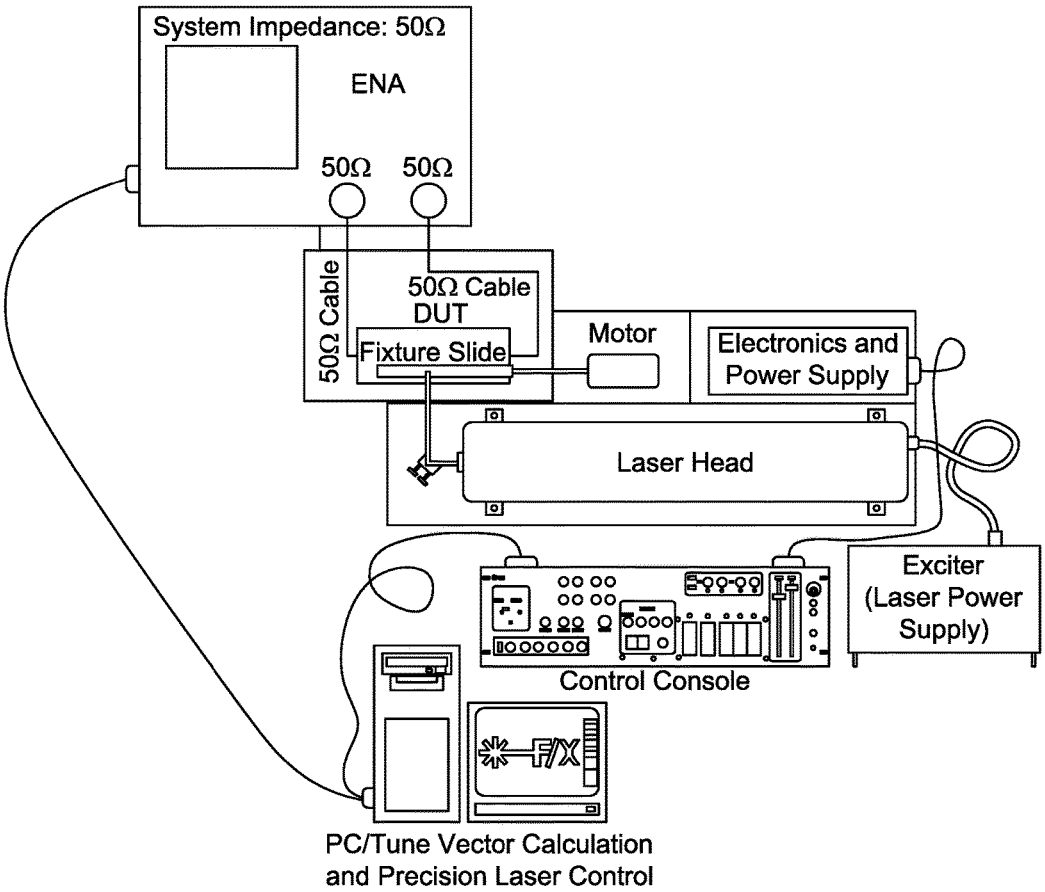
FIG. 6 illustrates a system for measuring and tuning a filter in a fixture according to an aspect of the application.

Further, as exemplarily shown in FIG. 6, the filter is tuned and measured for electrical characteristics. Specifically, the filter can be connected to a 4 port Keysight ENA Vector Analyzer. As depicted the system impedance is set to 50 ohms. 2-50 ohm cables connect the ENA vector analyzer to the filter. The ENA vector analyzer is connected to a computer that calculates the tune vector and controls the laser. In turn, the computer is operably coupled to a control console and electronic power supply.

In an embodiment, the slider bar is connected to a stepper motor that pulls slider 410 in and out allowing access to the filter for fast tuning and then closing again for accurate and repeatable RF measurements. The RF ports 121 of the bottom plate 100 are connected to a Vector Network Analyzer for real time measurements as the filter is being tuned to meet specifications. The laser head is connected to an exciter providing a supply of laser power to tune the filter when the slider is in the open position.

Figure 7:
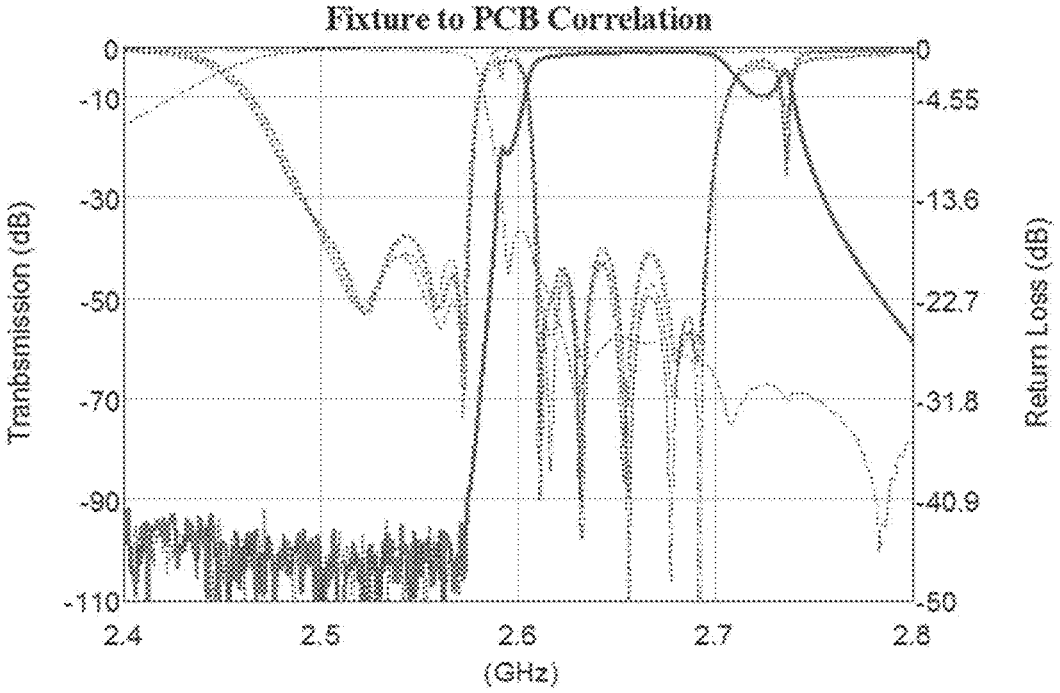
FIG. 7 illustrates transmission characteristics of a filter in the fixture compared with a filter on a printed circuit board according to an aspect of the application.

FIG. 7 is an illustration of the transmission data of the filter on a PCB versus in the fixture. The filter on a PCB is represented by three lines. One of these lines originates at 0 dB and 2.4 GHz and ends at 0 dB and 2.8 GHz. A second line begins and about −15 dB and 2.4 GHz and terminates at about −35 dB and 2.8 GHz. A third line begins at about −100 dB and 2.4 GHz and terminates at about −25 dB and 2.8 GHz. On the other hand, the filter in the fixture described above in this application is represented by at least one line that originates at 0 dB and 2.4 GHz and ends at 0 dB and 2.8 GHz. A second line begins at about −100 dB and 2.4 GHz and terminates at about −25 dB and 2.8 GHz. The data shows that there is a greater than 99% correlation between the fixture/filter system and the filter mounted on a PCB board.

Accordingly, the electrical performance of the filter is electrically the same in the fixture vs the PCB. Tables 1 and 2 below illustrates the results at all transmissions and those above −85 dB. T1, T2 and T3 are representative of the ports and BD is representative of the PCB.

TABLE 1

| Rejection | T1-T2 | T2-T3 | T1-T3 |
|---|---|---|---|
| All | 99.43% | 99.47% | 99.52% |
| >−85 dB | 100.00% | 99.99% | 100.00% |

TABLE 2

| Rejection | T1-BD | T2-BD | T1-BD | AVG to BD |
|---|---|---|---|---|
| All | 99.35% | 99.33% | 99.37% | 99.53% |
| >−85 dB | 99.95% | 99.97% | 99.95% | 99.96% |

Figure 8A:
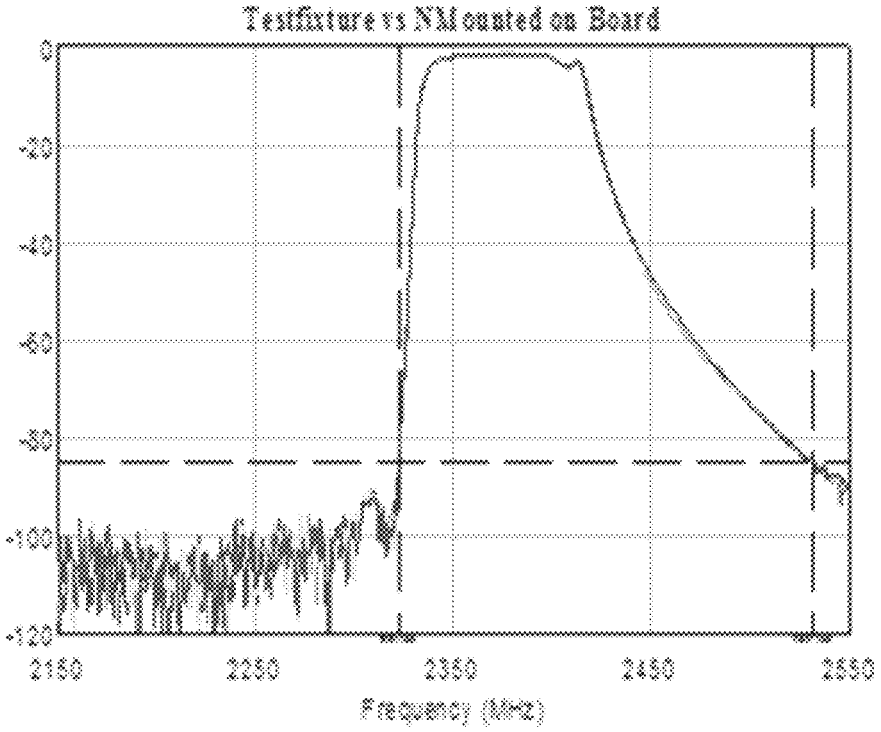
FIGS. 8A and 8B illustrate further comparative characteristics of a filter in the fixture and a filter on a printed circuit board according to an aspect of the application.
Figure 8B:
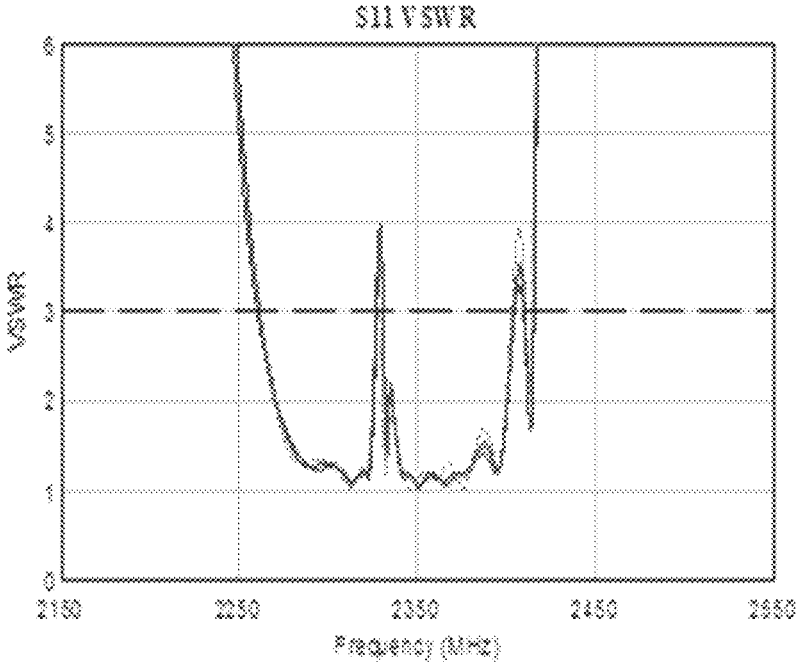

A correlation test was performed between the test fixture/filter and the filter mounted on a PCB. FIGS. 8A and 8B illustrate graphical representations of the correlated data. A filter mounted on a PCB was tested on band 30. The data in FIG. 8A indicates 99.45% correlation on transmission. The data in FIG. 8B indicates 98.63% correlation on the return loss (standing wave ratio (SWR)). Further the data indicates a 91.82% correlation on the noise floor.

While the system and method have been described in terms of what are presently considered to be specific embodiments, the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

What is claimed is:

1. A tuning and measurement fixture comprising:

a bottom plate including side surfaces, a top surface and a bottom surface, the bottom plate including a window extending between the top and bottom surfaces, the window configured to expose a through-hole of a filter positioned in the fixture, the top surface including a signal connection and a ground connection configured to communicate with the filter, the bottom surface including an RF port configured to transmit electrical characteristics of the filter, and a top plate including a top and a bottom surface, the top plate separated from the bottom plate by a predetermined height, the top plate including a window extending between the top and bottom surfaces, the window configured to expose the through-hole of the filter held in the fixture.

2. The fixture of claim 1, wherein the bottom plate includes a recessed channel extending a predetermined thickness from the top surface toward a core of the bottom plate.

3. The fixture of claim 2, wherein the recessed channel extends between two side surfaces of the bottom plate.

4. The fixture of claim 2, further comprising a slider bar located in the recessed channel, and a portion of the slider bar being located within the window.

5. The fixture of claim 1, further comprising a spacer located between the bottom and top plates, and positioned on the bottom plate around an area configured for the filter.

6. The fixture of claim 5, wherein the spacer is directly coupled to a ground connection.

7. The fixture of claim 5, further comprising a pad located between the bottom and top plates, below the spacer, and configured to contact a bottom surface of the filter.

8. The fixture of claim 1, wherein the bottom plate includes plural windows extending between the top and bottom surfaces, and the top plate includes plural windows extending between the top and bottom surfaces.

9. The fixture of claim 8, wherein the plural windows of the bottom plate have different lengths extending between two side surfaces of the bottom plate.

10. The fixture of claim 1, further comprising a fastening mechanism that secures the bottom plate to the top plate.

11. A method of tuning and measuring a filter in a fixture comprising:

providing the fixture including:

a bottom plate including a top surface and a bottom surface, the bottom plate including a window extending between the top and bottom surfaces, the top surface including a signal connection and a ground connection for communicating with the filter, and the bottom surface including an RF port for transmitting characteristics of the filter, and a top plate including a top and bottom surface, the top plate separated from the bottom plate by a predetermined height, the top plate including a window extending between the top and bottom surfaces;

positioning the filter between the bottom and top plates such that a through-hole of the filter is accessible through the window in the top plate;

tuning the filter via the window in the top plate; and measuring electrical characteristics of the filter via the RF port on the bottom plate.

12. The method of claim 11, wherein a recessed channel extends between two side surfaces of the bottom plate.

13. The method of claim 12, wherein the fixture further includes a slider bar located in the recessed channel, and a portion of the slider bar is located within the window.

14. The method of claim 13, further comprising moving the slide bar in and out of the recessed channel.

15. The method of claim 13, further comprising a spacer located between the bottom and top plates, and positioned on the bottom plate around an area configured for the filter.

16. The method of claim 15, wherein the spacer is directly coupled to the slide bar.

17. The method of claim 15, further comprising a pad located between the bottom and top plates, below the spacer, and configured to contact the filter.

18. The method of claim 11, wherein the bottom plate includes plural windows extending between the top and bottom surfaces, and the top plate includes plural windows extending between the top and bottom surfaces.

19. The method of claim 18, wherein the plural windows have different lengths extending between two side surfaces of the bottom plate.

20. The method of claim 11, wherein the tuning characteristics of the filter in the fixture is within 1% if the filter was positioned on a printed circuit board.

* * * * *